US011913241B2

(12) United States Patent
Papulski et al.

(10) Patent No.: US 11,913,241 B2
(45) Date of Patent: Feb. 27, 2024

(54) BLADE CONTROL SYSTEM AND FLOORING REMOVAL MACHINES INCORPORATING THE SAME

(71) Applicant: Taylor Tools, Denver, CO (US)

(72) Inventors: Keith Papulski, Morrison, CO (US); Juan Rodelo-Castillo, Denver, CO (US)

(73) Assignee: Taylor Tools, Denver, CO (US)

( * ) Notice: Subject to any disclaimer, the term of this patent is extended or adjusted under 35 U.S.C. 154(b) by 0 days.

(21) Appl. No.: 17/748,310

(22) Filed: May 19, 2022

(65) Prior Publication Data

US 2022/0381049 A1 Dec. 1, 2022

Related U.S. Application Data

(60) Provisional application No. 63/192,731, filed on May 25, 2021.

(51) Int. Cl.
*E04G 23/00* (2006.01)

(52) U.S. Cl.
CPC ..... *E04G 23/006* (2013.01)

(58) Field of Classification Search
CPC ..... E04F 23/006
See application file for complete search history.

(56) References Cited

U.S. PATENT DOCUMENTS

| | | | | |
|---|---|---|---|---|
| 5,702,161 | A * | 12/1997 | Finney | E01C 23/082 15/93.1 |
| 5,772,284 | A * | 6/1998 | Lindsey | E04G 23/006 15/93.1 |
| 6,523,906 | B1 * | 2/2003 | Holder | E01C 23/0885 15/93.1 |
| 6,988,776 | B1 * | 1/2006 | Davidson | E02F 3/844 15/93.1 |
| 2010/0201181 | A1 * | 8/2010 | Pope | E04G 23/006 299/37.1 |

* cited by examiner

*Primary Examiner* — Janine M Kreck
(74) *Attorney, Agent, or Firm* — Bejin Bieneman PLC

(57) ABSTRACT

A ride-on floor machine, including: a frame including a lower frame portion; a drive system carried by the frame; and a blade control system carried by the lower frame portion, the blade control system including: a blade holder pivotably attached proximate a front end of the lower frame portion; and a linear actuator coupled to the blade holder at a first end and coupled to the lower frame portion at a second end, wherein the actuator extends along a center line parallel to the lower frame portion and is operative to move between an extended position where the blade holder is in an up position and a retracted position where the blade holder is in a down position.

14 Claims, 5 Drawing Sheets

BLADE CONTROL SYSTEM AND FLOORING REMOVAL MACHINES INCORPORATING THE SAME

CROSS-REFERENCE TO RELATED APPLICATIONS

This application claims the benefit of and priority to U.S. Provisional Patent Application No. 63/192,731, filed May 25, 2021, the disclosure of which is incorporated herein by reference in its entirety.

TECHNICAL FIELD

This patent application is directed to flooring removal machines, and more specifically, to blade control systems for ride-on flooring removal machines.

BACKGROUND

Whenever new flooring is to be installed, any pre-existing flooring must be removed. Whether that flooring is tile, carpet, vinyl, ceramic, or hardwood, removing the material by hand can be difficult and laborious, especially when the flooring material is adhered to the underlying floor surface. Accordingly, flooring removal machines have been developed to more efficiently handle this task. In some cases, these machines are powered ride on machines with a movable blade that engages the floor surface and strips off the flooring as the machine is propelled forward.

SUMMARY

In some aspects, the techniques described herein relate to a ride-on floor machine, including: a frame including a lower frame portion; a drive system carried by the frame; and a blade control system carried by the lower frame portion, the blade control system including: a blade holder pivotably attached proximate a front end of the lower frame portion; and a linear actuator coupled to the blade holder at a first end and coupled to the lower frame portion at a second end, wherein the actuator extends along a center line parallel to the lower frame portion and is operative to move between an extended position where the blade holder is in an up position and a retracted position where the blade holder is in a down position.

In some aspects, the techniques described herein relate to a ride-on floor machine, further including an intermediate link coupling the actuator to the blade holder.

In some aspects, the techniques described herein relate to a ride-on floor machine, wherein the actuator is a hydraulic cylinder having a rod eye pivotably coupled to the intermediate link.

In some aspects, the techniques described herein relate to a ride-on floor machine, wherein the intermediate link includes a clevis coupled to a tie rod via an adjusting nut, wherein the clevis is pivotably coupled to the rod eye and the tie rod is pivotably coupled to the blade holder.

In some aspects, the techniques described herein relate to a ride-on floor machine, wherein the actuator is a hydraulic cylinder having a cylinder rod and the lower frame portion includes a rear end with a lower panel extends between the front end and the rear end.

In some aspects, the techniques described herein relate to a ride-on floor machine, further including a shaft support bracket positioned to hold the cylinder rod parallel with respect to the lower panel.

In some aspects, the techniques described herein relate to a ride-on floor machine, further including a pair of guide plates positioned on opposite sides of the blade holder, each guide plate including an arcuate groove positioned to receive a corresponding guide pin attached to the blade holder.

In some aspects, the techniques described herein relate to a blade control system for use on a ride-on floor machine, including: a frame portion attachable to the ride-on floor machine; a blade holder pivotably attached proximate a front end of the frame portion; and a linear actuator, e.g. hydraulic cylinder, coupled to the blade holder at a first end and coupled to the lower frame portion at a second end, wherein the actuator extends along a center line parallel to the lower frame portion and is operative to move between an extended position where the blade holder is in an up position and a retracted position where the blade holder is in a down position.

In some aspects, the techniques described herein relate to a blade control system, further including an intermediate link coupling the actuator to the blade holder.

In some aspects, the techniques described herein relate to a blade control system, wherein the actuator is a hydraulic cylinder having a rod eye pivotably coupled to the intermediate link.

In some aspects, the techniques described herein relate to a blade control system, wherein the intermediate link includes a clevis coupled to a tie rod via an adjusting nut, wherein the clevis is pivotably coupled to the rod eye and the tie rod is pivotably coupled to the blade holder.

In some aspects, the techniques described herein relate to a blade control system, wherein the actuator is a hydraulic cylinder having a cylinder rod and the lower frame portion includes a rear end with a lower panel extends between the front end and the rear end.

In some aspects, the techniques described herein relate to a blade control system, further including a shaft support bracket positioned to hold the cylinder rod parallel with respect to the lower panel.

In some aspects, the techniques described herein relate to a blade control system, further including a pair of guide plates positioned on opposite sides of the blade holder, each guide plate including an arcuate groove positioned to receive a corresponding guide pin attached to the blade holder.

In some aspects, the techniques described herein relate to a ride-on floor machine, including: a frame including a lower frame portion, wherein the lower frame portion includes a front end and a rear end with a lower panel extending therebetween; a drive system carried by the frame; and a blade control system carried by the lower frame portion, the blade control system including: a blade holder pivotably attached proximate the front end of the lower frame portion; a hydraulic cylinder coupled to the blade holder at a first end and coupled to the lower panel at a second end, wherein the cylinder includes a cylinder rod extending along a center line and is operative to move between an extended position where the blade holder is in an up position and a retracted position where the blade holder is in a down position; and a shaft support bracket mounted to the lower panel and positioned to hold the cylinder rod parallel with respect to the lower panel.

In some aspects, the techniques described herein relate to a ride-on floor machine, further including an intermediate link coupling the cylinder rod to the blade holder.

In some aspects, the techniques described herein relate to a ride-on floor machine, wherein the intermediate link includes a clevis coupled to a tie rod via an adjusting nut, wherein the clevis is pivotably coupled to a rod eye of the cylinder rod and the tie rod is pivotably coupled to the blade holder.

In some aspects, the techniques described herein relate to a ride-on floor machine, further including a pair of guide plates positioned on opposite sides of the blade holder, each guide plate including an arcuate groove positioned to receive a corresponding guide pin attached to the blade holder.

BRIEF DESCRIPTION OF THE DRAWINGS

The blade control systems and flooring removal machines described herein may be better understood by referring to the following Detailed Description in conjunction with the accompanying drawings, in which like reference numerals indicate identical or functionally similar elements.

Figure 1:
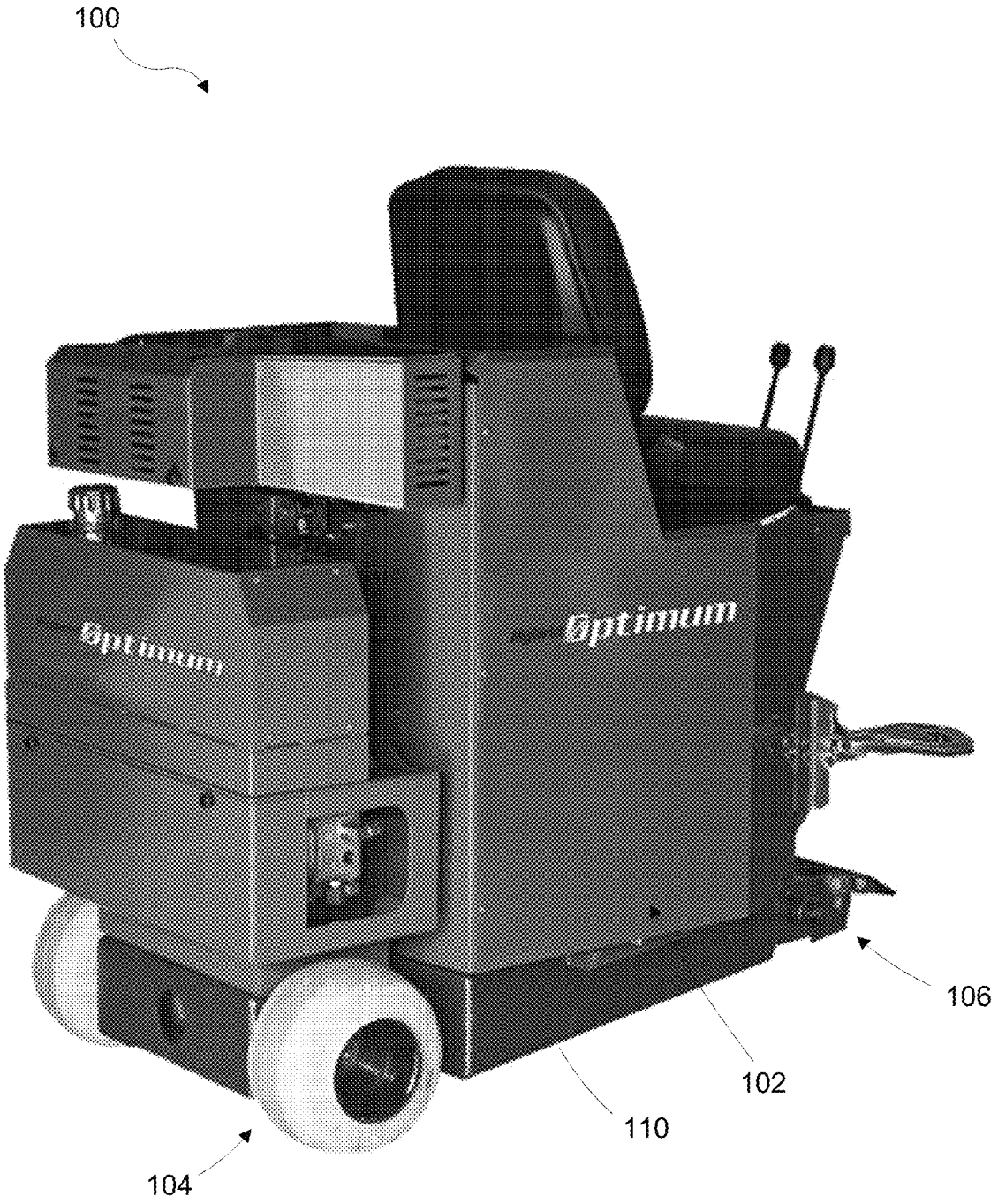
FIG. 1 is a perspective view of a ride-on flooring removal machine according to a representative embodiment.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. On the contrary, the embodiments are intended to cover all suitable modifications, combinations, equivalents, and alternatives falling within the scope of this disclosure.

DETAILED DESCRIPTION

Various examples of the devices introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

Disclosed herein are flooring removal machines incorporating improved blade control systems. The disclosed blade control systems increase the range of motion of the blade holder on ride-on floor removal machines (Battery and Propane). This unique blade control system has a cylinder with attachment points that are on a parallel plane. A joint at the end of the cylinder shaft increases the range of rotation on the blade holder. In addition, there is a shaft support on the face of the cylinder that isolates the lateral loads generated by the joint at the end of the cylinder shaft, and thus protects the shaft seal on the front of the cylinder and the cylinder shaft.

FIG. 1 illustrates a ride-on flooring removal machine 100 according to a representative embodiment. The ride-on flooring removal machine 100 can include a frame 102, a drive system 104, and a blade control system 106. The frame 102 can include a lower frame portion 110 that carries the blade control system 106. The blade control system 106 carries a blade (not shown) and is operative to move the blade to engage a floor surface to strip off the flooring as the machine is propelled forward by the drive system 104.

Figure 2:
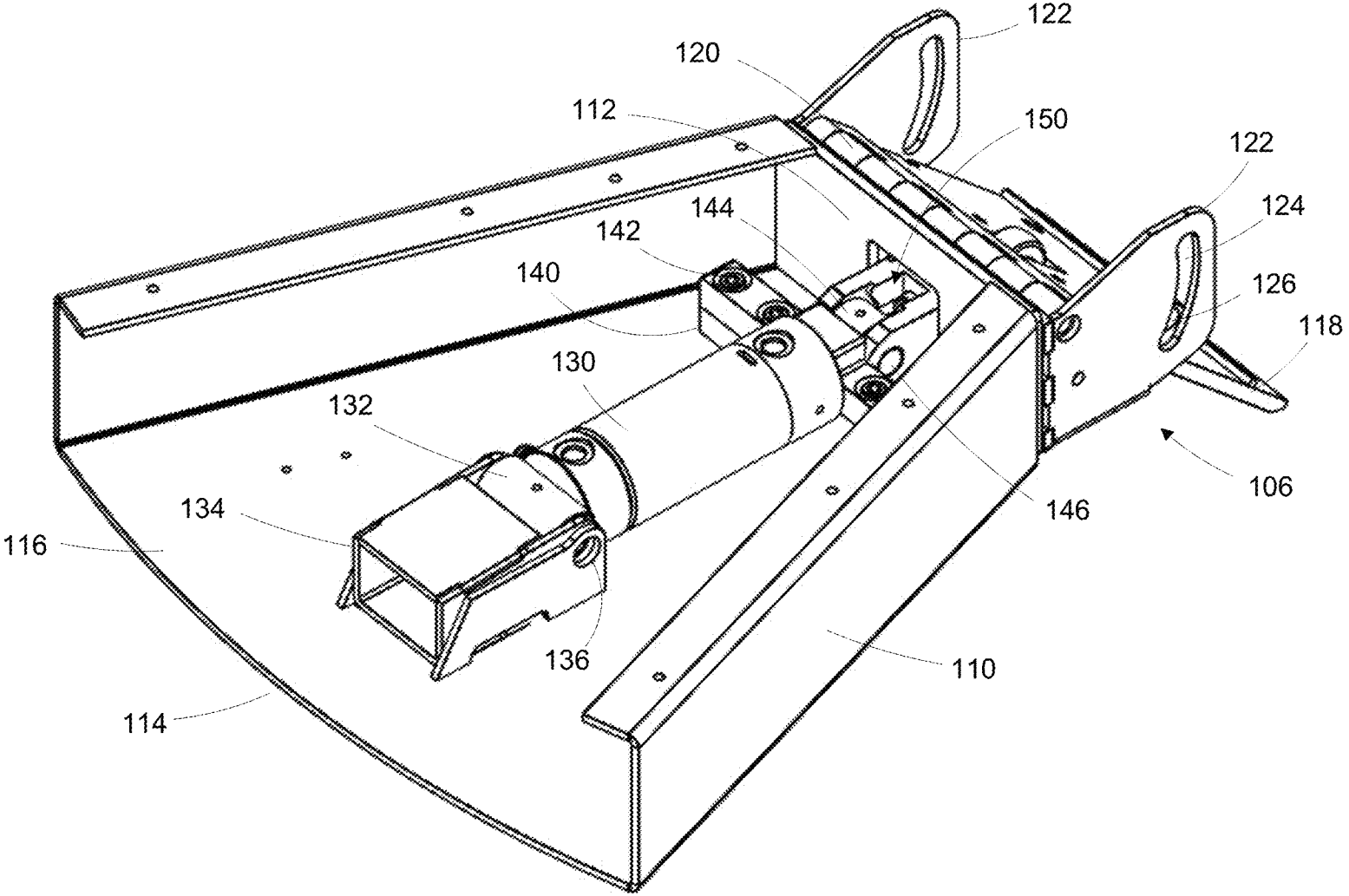
FIG. 2 is an isometric view of the lower frame portion and blade control system according to a representative embodiment with the blade holder in the down position.

With reference to FIG. 2, the lower frame portion 110 includes a front end 112 and a rear end 114 with a lower panel 116 extending therebetween. In some embodiments, the lower frame portion 110 can comprise folded sheet metal or a weldment, or a combination of the two.

In some embodiments the blade control system 106 can include a blade holder 118 that is rotatably attached proximate the front end 112 of the lower frame portion 110 with a suitable mechanism, such as a hinge 120. Thus, the blade holder 118 (and blade) can be rotated between an up position and a down position (i.e., engaged with the floor), as shown in FIG. 2. A pair of guide plates 122 can be positioned on opposite sides (i.e., left and right) of the blade holder 118. Each guide plate 122 includes an arcuate groove 124 positioned to receive a corresponding guide pin 126.

The blade control system 106 can be actuated with a suitable actuator (e.g., linear), such as a hydraulic cylinder 130. The cylinder 130 includes a cap end cross-tube 132, a cylinder rod 138, and a rod eye 144. The cap end cross-tube 132 (also referred to as an eye) can be coupled to the lower panel 116 with a rear bracket 134 and associated cap pin 136. In some embodiments, the cylinder rod, or shaft, 138 (not visible) is supported by a shaft support bracket 140. In the depicted embodiment, the support bracket 140 comprises two halves clamped to the lower surface 116 and around the cylinder rod 138 with suitable hardware, such as socket head cap screws 142. The support bracket 140 isolates the lateral loads generated by the joint at the end of the cylinder shaft, and thus protects the shaft seal on the front of the cylinder and the cylinder shaft. The rod eye 144 is coupled to the blade holder 118 via an intermediate link 150 pivotably coupled to the rod eye 144 with an associated rod pin 146.

Figure 3:
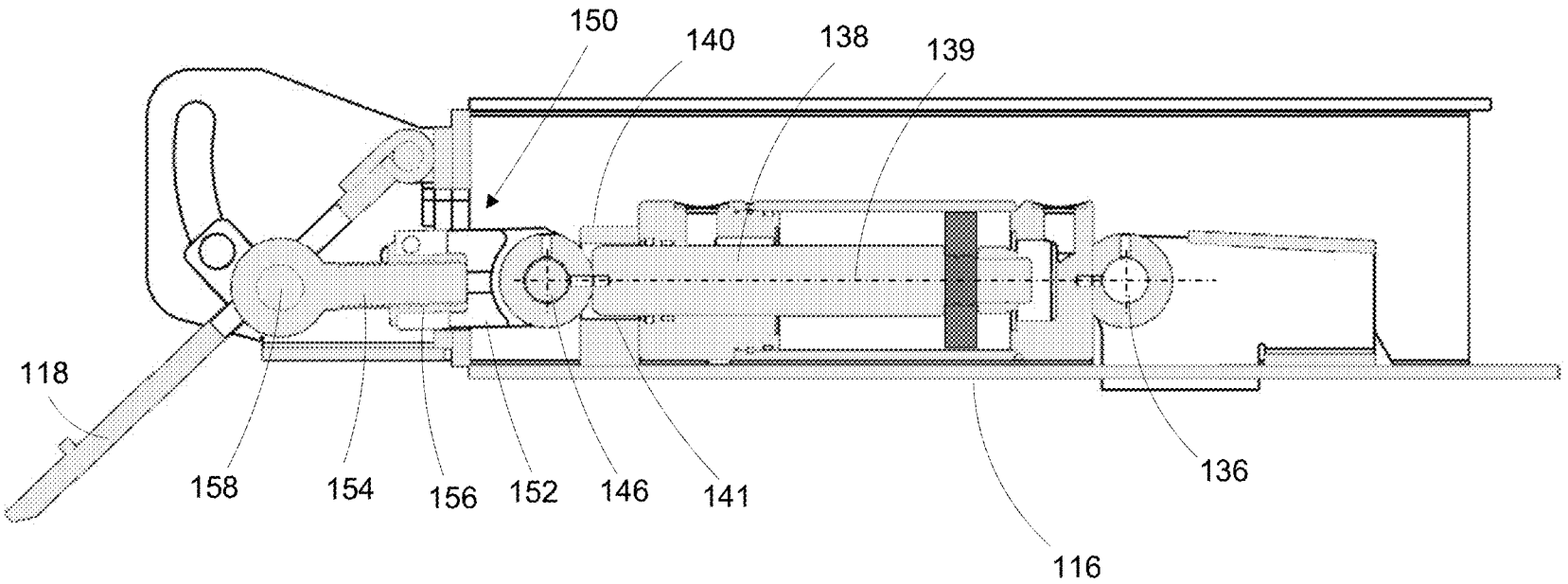
FIG. 3 is a side-view in cross-section of the lower frame portion and blade control system shown in FIG. 2.

With reference to FIG. 3, the intermediate link 150 can comprise a clevis 152 coupled to a tie rod 154 via an adjusting nut 156. The clevis 152 is rotatably coupled to the rod eye pin 146, as noted above. The tie rod 154 is rotatably coupled to the blade holder 118 with a mounting pin 158. When the cylinder rod 138 is in the retracted position, the blade holder 118 is in the down position, as shown. When the cylinder rod 138 is in the extended position, the blade holder 118 is in the up position (e.g., FIGS. 4 and 5).

The shaft support bracket 140 includes a bearing, such as sleeve bearing 141. The bearing can comprise plastic, bronze, or other suitable bearing material. The support bracket 140 is positioned to hold the cylinder rod 138 horizontal with respect to the lower panel 116. Accordingly, the centers of rod pin 146 and cap pin 136 (e.g., front and rear, respectively) lie in a horizontal plane extending along the rod center line 139 that is parallel to the lower panel 116. This arrangement allows the cylinder 130 to be contained entirely within the lower frame portion 110, thereby protecting it and the associated hydraulic lines and controls (not shown) from flooring debris.

Figure 4:
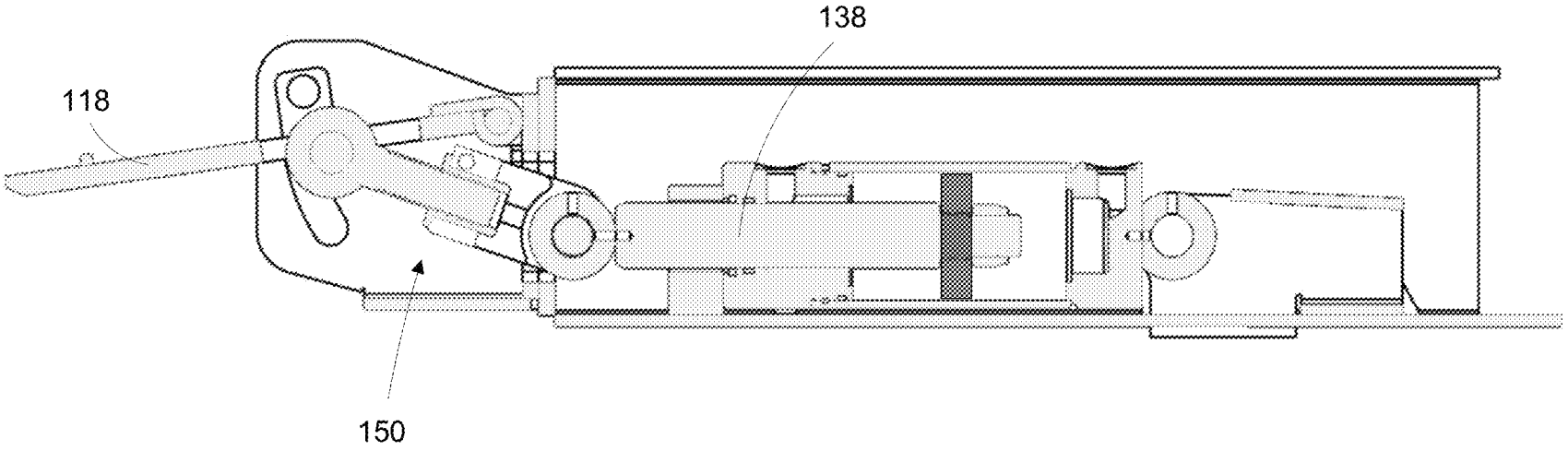
FIG. 4 is a side-view in cross-section of the lower frame portion and blade control system with the blade holder in the up position.
Figure 5:
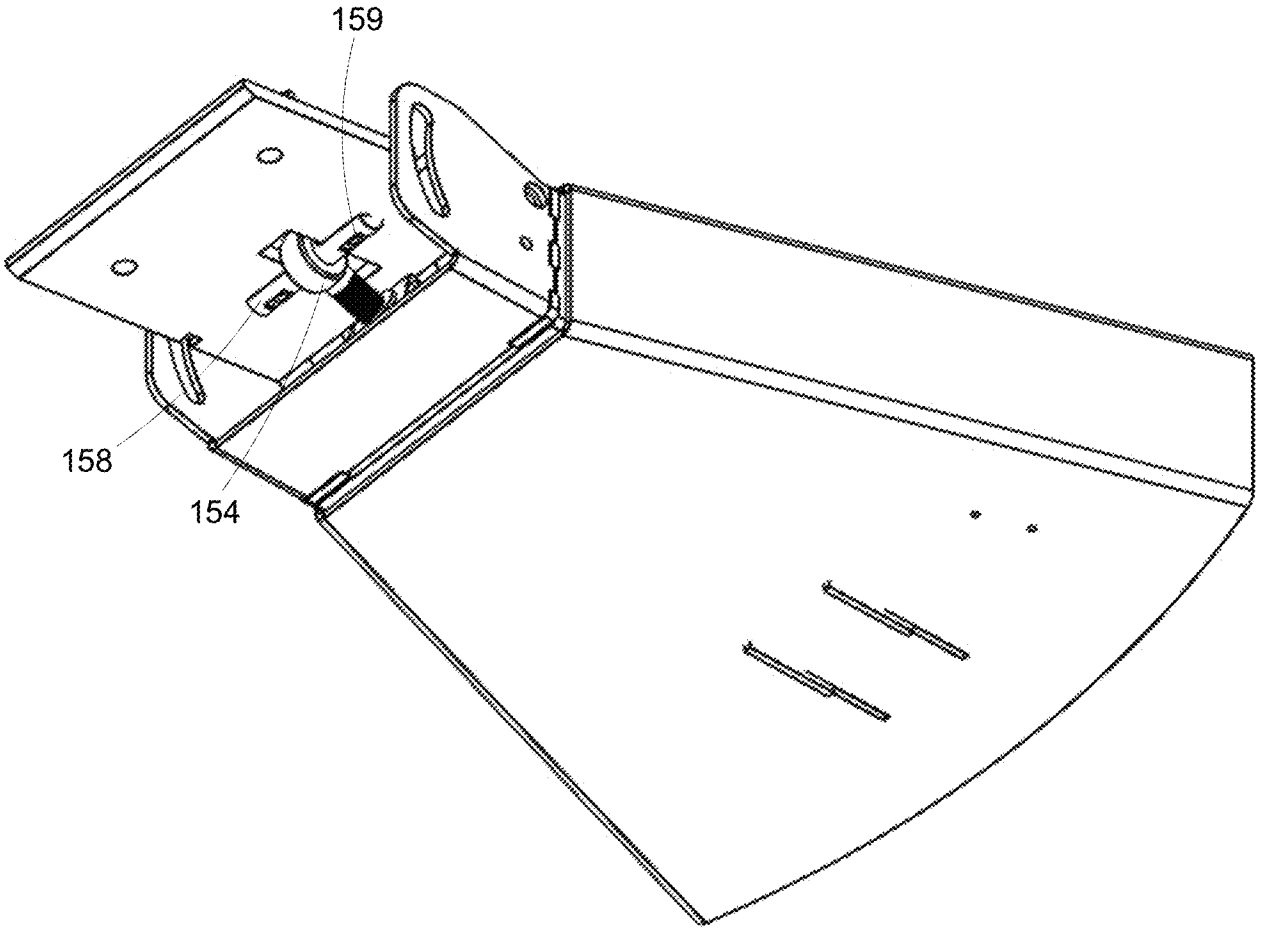
FIG. 5 is an isometric view of the lower frame portion and blade control system viewed from underneath with the blade holder in the up position.

FIG. 4 is a side-view in cross-section of the lower frame portion 110 and blade control system 106, similar to FIG. 3, with the blade holder 118 in the up position. The cylinder rod 138 is extended which pushes the intermediate link 150 forward as it rotates upward with the blade holder 118. With further reference to FIG. 5, the tie rod 154 is rotatably coupled to the blade holder 118 with the mounting pin 158. In some embodiments, the mounting pin 158 includes flat end portions that abut the blade holder 118. The flat end portions can be fastened to the blade holder with suitable hardware, such as screws 159.

REMARKS

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A ride-on floor machine, comprising:

a frame including a lower frame portion having a lower panel extending between a front end and a rear end;

a drive system carried by the frame; and a blade control system carried by the lower frame portion, the blade control system including:

a blade holder pivotably attached proximate the front end of the lower frame portion;

a linear actuator coupled to the blade holder at a first end and coupled to the lower frame portion at a second end, wherein the actuator extends along a center line parallel to the lower frame portion and is operative to move between an extended position where the blade holder is in an up position and a retracted position where the blade holder is in a down position, wherein the actuator is a hydraulic cylinder having a cylinder rod; and a shaft support bracket positioned to hold the cylinder rod parallel with respect to the lower panel.

2. The ride-on floor machine of claim 1, further comprising an intermediate link coupling the actuator to the blade holder.

3. The ride-on floor machine of claim 2, wherein the hydraulic cylinder includes a rod eye pivotably coupled to the intermediate link.

4. The ride-on floor machine of claim 3, wherein the intermediate link comprises a clevis coupled to a tie rod via an adjusting nut, wherein the clevis is pivotably coupled to the rod eye and the tie rod is pivotably coupled to the blade holder.

5. The ride-on floor machine of claim 1, further comprising a pair of guide plates positioned on opposite sides of the blade holder, each guide plate including an arcuate groove positioned to receive a corresponding guide pin attached to the blade holder.

6. A blade control system for use on a ride-on floor machine, comprising:

a frame portion attachable to the ride-on floor machine, wherein the frame portion includes a lower panel extending between a front end and a rear end;

a blade holder pivotably attached proximate the front end of the frame portion;

a linear actuator coupled to the blade holder at a first end and coupled to the frame portion at a second end, wherein the actuator extends along a center line parallel to the frame portion and is operative to move between an extended position where the blade holder is in an up position and a retracted position where the blade holder is in a down position, wherein the actuator is a hydraulic cylinder having a cylinder rod; and a shaft support bracket positioned to hold the cylinder rod parallel with respect to the lower panel.

7. The blade control system of claim 6, further comprising an intermediate link coupling the actuator to the blade holder.

8. The blade control system of claim 7, wherein the hydraulic cylinder includes a rod eye pivotably coupled to the intermediate link.

9. The blade control system of claim 8, wherein the intermediate link comprises a clevis coupled to a tie rod via an adjusting nut, wherein the clevis is pivotably coupled to the rod eye and the tie rod is pivotably coupled to the blade holder.

10. The blade control system of claim 6, further comprising a pair of guide plates positioned on opposite sides of the blade holder, each guide plate including an arcuate groove positioned to receive a corresponding guide pin attached to the blade holder.

11. A ride-on floor machine, comprising:

a frame including a lower frame portion, wherein the lower frame portion includes a front end and a rear end with a lower panel extending therebetween;

a drive system carried by the frame; and a blade control system carried by the lower frame portion, the blade control system including:

a blade holder pivotably attached proximate the front end of the lower frame portion;

a hydraulic cylinder coupled to the blade holder at a first end and coupled to the lower panel at a second end, wherein the cylinder includes a cylinder rod extending along a center line and is operative to move between an extended position where the blade holder is in an up position and a retracted position where the blade holder is in a down position; and a shaft support bracket mounted to the lower panel and positioned to hold the cylinder rod parallel with respect to the lower panel.

12. The ride-on floor machine of claim 11, further comprising an intermediate link coupling the cylinder rod to the blade holder.

13. The ride-on floor machine of claim 12, wherein the intermediate link comprises a clevis coupled to a tie rod via an adjusting nut, wherein the clevis is pivotably coupled to a rod eye of the cylinder rod and the tie rod is pivotably coupled to the blade holder.

14. The ride-on floor machine of claim 11, further comprising a pair of guide plates positioned on opposite sides of the blade holder, each guide plate including an arcuate groove positioned to receive a corresponding guide pin attached to the blade holder.

* * * * *